United States Patent [19]

Judd

[11] 4,063,793

[45] Dec. 20, 1977

[54] FLIP LIP BOOT FOR PLUGS AND CONNECTORS

[75] Inventor: Edwin B. Judd, Greenwich, R.I.

[73] Assignee: General Electric Company, New York, N.Y.

[21] Appl. No.: 739,926

[22] Filed: Nov. 8, 1976

Related U.S. Application Data

[63] Continuation of Ser. No. 562,991, March 28, 1975, abandoned.

[51] Int. Cl.[2] ..... H01R 11/02

[52] U.S. Cl. ..... 339/60 R; 339/94 R; 339/211; 339/213 R

[58] Field of Search ..... 339/60 M, 60 R, 59 R, 339/61 R, 61 M, 94 R, 94 C, 94 L, 94 M, 101, 200 R, 201, 204, 211, 213 R

[56] References Cited

U.S. PATENT DOCUMENTS 3,120,987 2/1964 Degnan et al. ..... 339/60 M

*Primary Examiner*—Gerald A. Dost
*Assistant Examiner*—DeWalden W. Jones
*Attorney, Agent, or Firm*—Paul E. Rochford; Walter C. Bernkopf

[57] ABSTRACT

A boot for an electrical cap and connector is provided in the form of a resilient tubular sheath. The midportion of the sheath conforms closely to a portion of the body of the cap or connector. There are two end portions which are of smaller diameter. One end portion is tapered to fit about a cord extending from the cap or connector and provides a seal against the cord surface. The other end of the connector is preferably of a diameter slightly less than that of the midportion of the boot and extends from or over the end of the body of the cap or connector. The resiliency of the material of the cap or connector boot permits the automatic overlapping of one of the extended smaller diameter sections over the other to form an effective seal at their juncture against outside environments.

5 Claims, 9 Drawing Figures

FLIP LIP BOOT FOR PLUGS AND CONNECTORS

This is a continuation of application Ser. No. 562,991, filed Mar. 28, 1975 now abandoned.

CROSS REFERENCE TO RELATED APPLICATION

The subject application covers utility aspect of a connector boot product. The design of this product has some similarity to the design disclosed and claimed in the application of the same inventor herein, Edwin B. Judd, Ser. No. 465054, filed Apr. 29, 1974.

BACKGROUND

It is known that electrical caps and connectors are employed in many different locations, such as industrial factories, mines, construction sites, and other locations where the environment may be detrimental to the proper functioning of such caps and connectors. For example, in many marine applications the caps and connectors are needed in supplying electric power to boats or to equipment used at dockside or in locations where the marine elements may have access to the interior of the cap and connector either as a spray or as a film carried on equipment with which the caps and connectors are associated. Where such caps and connectors are exposed to environments which may be deleterious to their proper operation, it has been found desirable to provide boots to fit over the respective cap and connector and to, in this way, provide a means of protection for the cap and connector to keep undesirable elements away from the interior.

Such boots have been known in the art and typical patents which disclose and describe such boots and their use and association with caps and connectors include U.S. Pat. Nos. 2,037,630; 2,127,544; 2,284,945; 2,357,719; 2,466,997; 2,742,622; 2,758,291; 2,782,391; 2,891,101; 2,978,533; 3,020,516; 3,120,987; 3,167,374; 3,601,761; 3,683,315; British Pat. Nos. 490,013 and 771,386. It will be noted that for each of these patents the requirement for construction of a successful pair of boots is that one boot be different from the other, particularly with reference to the surfaces at which the seal is made between the members of a pair. The only boots known to the Applicant which are not manufactured in a matched pair are the boots manufactured by Bryant Electric Company and these boots are manufactured as two identical oppositely facing members. Where the Bryant cap and connector are joined together, the edges of the boots are designed to butt if they reach each other to form a seal.

OBJECTS OF THE INVENTION

It is accordingly one object of the present invention to provide an improved boot article for caps and connectors.

Another object of the invention is to provide a low cost boot which is highly effective and efficient in use.

Another object is to provide a combination of a boot and a connector associated with the boot to permit the boots to be protected from their environments.

Another object is to provide a single form of boot which may be employed with either a cap or connector.

Another object is to provide boots capable of forming an overlapping seal automatically and without need for special measures or steps to generate the overlapping seal.

Other objects and advantages of the present invention will be in part apparent and in part pointed out in the description which follows.

FIG,. 6 is a side elevational view of a connector shown within a boot and with the boot illustrated partially in section.

Figure 7:
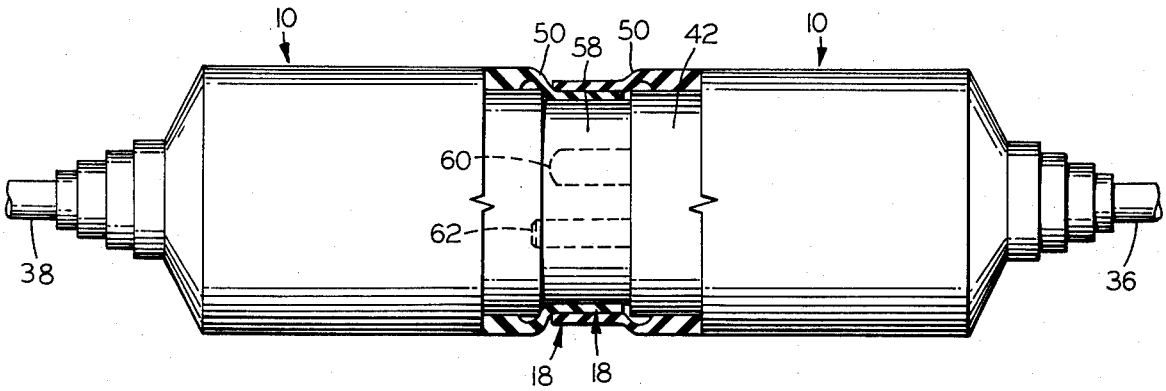

FIG. 7 is an elevational view of a cap and connector each protected by the boot of this invention with the cap and connector joined and with the boot in place to provide a sealed junction about the cap and connector, the boot being illustrated in part in section.

Figure 8:
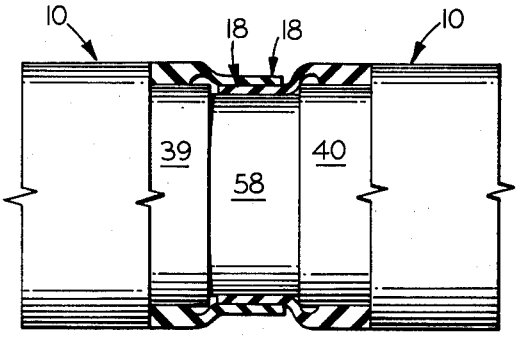

FIG. 8 is a view similar to that of FIG. 7 but illustrating an alternative arrangement of the lips of the boot.

Figure 9:
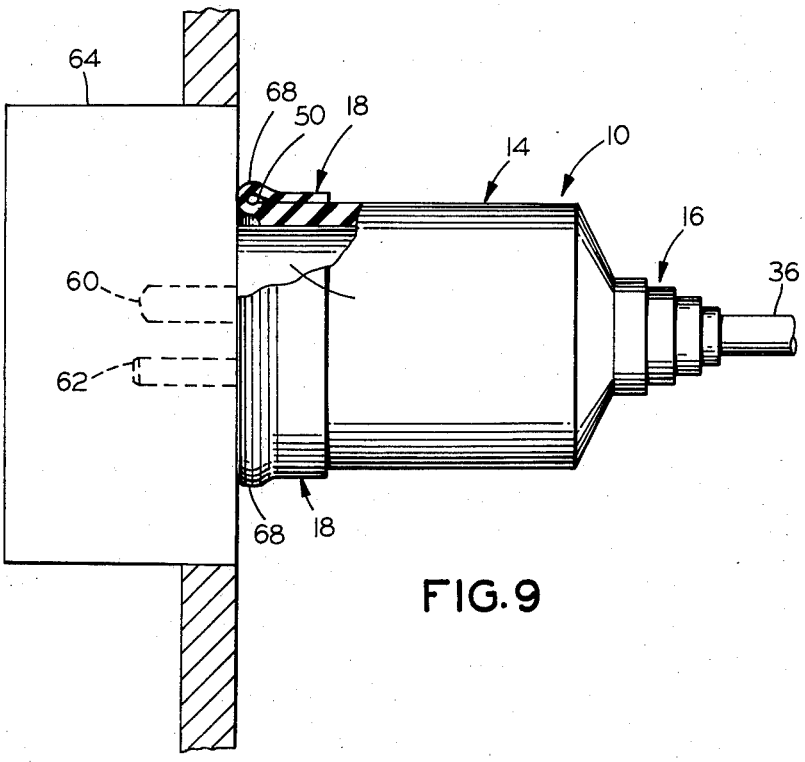

FIG. 9 is an elevational view of a cap within a boot of the present invention where the cap is inserted in a receptacle mounted in a wall.

DESCRIPTION OF THE PREFERRED EMBODIMENT

Referring now to the drawings, a typical boot 10 as constructed and employed pursuant to this invention includes a midportion of larger diameter 14, a rear end portion 16 of smaller diameter for forming a seal about a cable and a front end portion of smaller diameter 18 employed to form a seal with another boot of similar construction. The boot itself is made of a resilient or flexible material and preferably one of which is highly flexible. Such material may be rubber including hypalon rubber and other rubbers which have good properties of high flexibility combined with resistance to aging and resistance to decay from contact with materials found in the environment in which such booted caps and connectors are employed.

The cable contacting rear end 16 of the boot may be stepped to permit use with cables of different diameters in a fashion known in the art. For this purpose a number of individual stepped rings 20, 22, 24, and 26 are formed integrally with the end of the boot and these rings have different diameters both internally and externally as is evident from the sectional view of FIG. 3. Other forms of tapered cable contacting end portions of the boot of this invention may be employed as for example a tapered portion without steps or alternatively a tapered portion with another form of steps. Where cables of larger diameters are employed, one or more of the rings 20, 22, 24 may be removed in the fashion taught in the Colbert patent concerning a "Cable Splice Enclosure" U.S. Pat. No. 2,978,533 to permit appropriate contact of the larger diameter section of the cable contacting tapered end with the larger diameter cable passing therethrough. Also, generally the wall thickness of the tapered cable contacting end 16 of the boot may be smaller than that of the midportion 14 of the boot. A beveled connection section 28 of frustroconical form connects the tapered cable-contacting end portion 16 of the boot to the larger diameter midportion 14.

Figure 1:
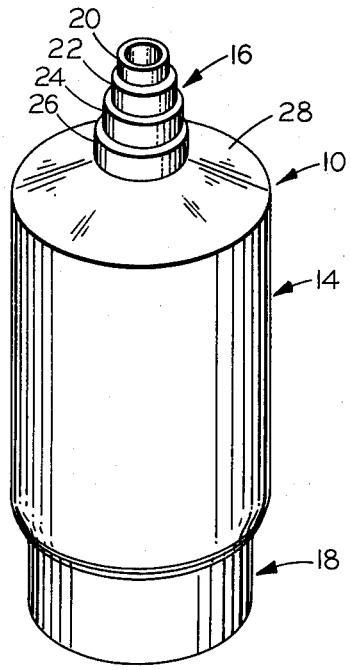
FIG. 1 is a perspective view of a boot for caps and connectors as provided pursuant to this invention.
Figure 2:
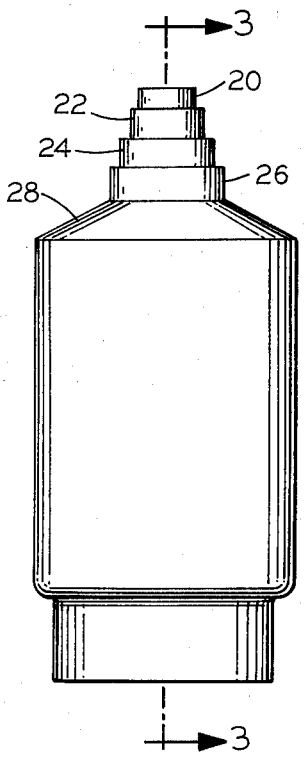
FIG. 2 is a side elevational view of the boot of FIG. 1.
Figure 3:
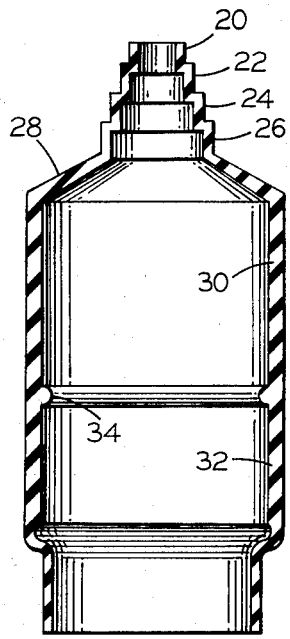
FIG. 3 is a vertical sectional view of the boot of FIG. 2 taken along the lines 3-3 of FIG. 2.
Figure 4:
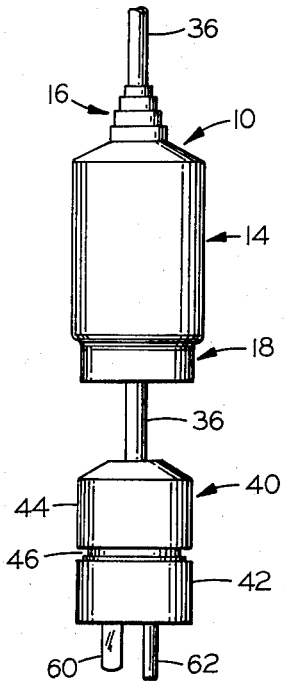
FIG. 4 is an elevational view of a pre-assembly arrangement of a cap and a boot arranged concentrically on a wire.
Figure 5:
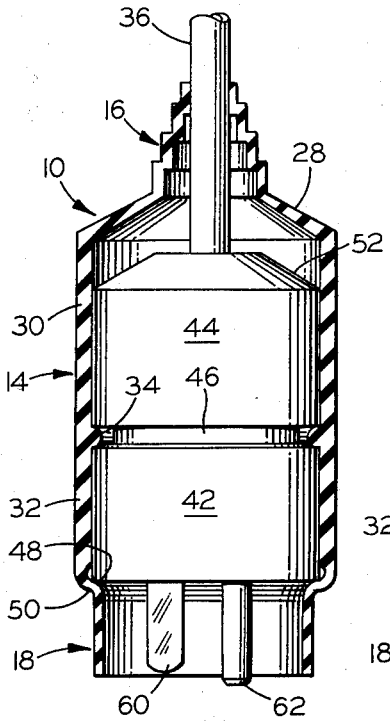
FIG. 5 is a side elevational view of a cap positioned within a boot with the boot shown in section as in FIG. 3.

The empty boot as illustrated in FIGS. 1, 2, and 3 may be assembled to a cap in the manner illustrated in FIGS. 4 and 5. Thus in FIG. 4 the wire or cable 36 is first threaded through the empty boot 10 to extend all the way through the length of the boot. Then the cable is connected to the cap 40. After the cable is securely fastened within the cap, the boot 10 is pulled down and over the cap 40 to take the position enclosing the boot as illustrated best in FIG. 5. The flexible character of the boot 10 permits the narrower front end portion 18 to expand out and over the cap 40 and to resume its narrower diameter configuration after it has passed fully over the boot as illustrated in FIG. 5. Similarly due to the flexibility of the boot it may be removed from the cap 40 by a reverse of the mounting steps described above.

Considering next the larger diameter midportion 14, this portion is treated in two sections, essentially an upper section 30 and a lower section 32 as illustrated in FIG. 3. These two sections are separated by an internal annular band 34.

It is further evident that the cap itself as illustrated in FIGS. 4 and 5 has a lower body 42, an upper body 44, and a gap 46 therebetween. The dimensions of the boot portions are made to conform to the cap and/or connector structure with which it is to be employed. In particular, the lower portion 32 of the boot nests about and grips the lower body 42 of the cap.

Note in particular that band 34 fits within the gap 46 between the lower body 42 and the upper body 44 of the cap. Also note that the lower perimeter 48 of body 42 nests in a shoulder 50 formed between the lower section 30 of midportion 14 and the narrow diameter lower portion 18 of boot 10. In this regard there is a cooperation between the connector 40 within the boot and the boot itself or more specifically between portions of the connector 40 and portions of the boot 10. Specifically the external dimensions of the body 42 of cap 40 are matched to those of the lower section 32 of boot 14 so that the body 42 extends between the inwardly extending band 34 and the inwardly extending shoulder 50. The body 42 is accordingly nested in the lower section 32 of the midportion 14 of boot 19 and is held in position partly by the band 34 above and partly by the shoulder 50 beneath. The band and shoulder bear respectively against the upper and lower perimeters of the body 42. The dimensions of the body 42 match those of the lower section 32 and the cap is held in a preferred position within the boot 10 by virtue of the dimensional relations between the section 32 of the boot and body 42 of the cap.

By contrast, the upper body 44 of the cap is not in contact with the beveled portion 28 or more precisely need not be in contact with the beveled portion 28 of the boot.

An important feature of boot of this invention is the cooperation with the cap with which it is employed. A cap with which it may preferably be employed is to be described in co-pending application of Robert Maloof and Luther Sheldon, Ser. No. 572,794 filed Apr. 29, 1975. As will be explained more fully in the co-pending application, the upper body 44 of the cap is in threaded engagement with the lower body and the relative angular motion between body 44 and body 42 causes the body 44 to ascend or descend relative to lower body 42. The ascent or descent is made in connection with the operation of a cord grip and generally for cords of larger diameter than 36 shown in FIG. 5, the upper body 44 of the cap would be separated from lower body 42 by a larger distance. In other words, as larger cables are used in connection with the cap, the gap 46 is enlarged and the beveled upper surface 52 of body 44 is in closer proximity to the beveled portion 28 of boot 10. An important feature in the relationship between the cap and boot is that regardless of the dimensions of the gap 46, the lower body portion 42 of cap 40 is nested in its proper position in alignment within the boot 10 to retain the lower perimeter 48 against the shoulder 50 and to provide a proper alignment of the cap within the boot so that mating contact with a connector to form a seal between the two boots may be accomplished in a manner described more fully below.

Figure 6:
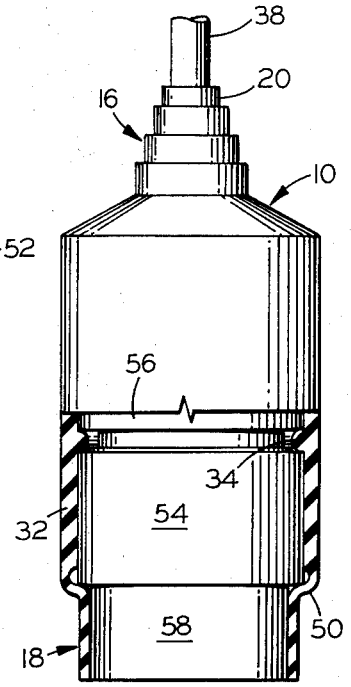

Considering next the relation of a boot 10 to a connector such as is illustrated in FIG. 6, the boot 10 is adapted to cover the connector. Such protection is accomplished partly by the sealing contact of an upper ring 20 of the tapered portion 16 with a cable 38. It is also partly accomplished by the enclosing a lower body 54 within the lower section 32 of midportion 14. The same desirable dimensional relationships exist between section 32 of the connector and specifically body 54 of the connector, as existed between the same section of the boot and the body 42 of cap 40. In particular the lower section 32 of the midportion 14 of the boot encloses the lower body 54 of the connector and provides a gripping contact with the upper perimeter of body 54 at the band 34 and with the lower perimeter of the body 54 at the shoulder 50. Accordingly the same boot can be used with either the cap or the connector of the construction described herein and can provide a gripping contact with the cap or connector by gripping the the lower body of the cap or connector respectively as described above.

One distinction between the manner in which the boot encloses the cap as illustrated in FIG. 5, and the manner in which the connector is enclosed as illustrated in FIG. 6 is that the lower portion 18 of the boot actually contacts and encloses the contact housing body 58 of the connector. The contact housing body 58 is that part of the connector which contains the contacts which are provided to receive the matching blade contacts 60 and 62 of the cap 40. The front end portion 18 of boot 10 forms a skirt about blade contacts 60 and 62 of cap 40.

Turning now to the positioning of the endpportion 18 of boot 10 on the cap when the cap is connected to the connector, one such positioning is illustrated in FIG. 7 where the cap and connector are shown joined together in the conventional fashion. Referring to FIG. 7, it is evident that the connector 39 on the left is engaged by the cap 40 on the right and that the boot 10 of the cap 40 is essentially the same as the boot 10 of the connector 39. At the central portion of the joined cap and connector, with their associated boots, the illustration of FIG. 7 is in section and this makes it possible to see the overlapping portions of the boots in the form they assume when the cap and connector are joined. Also, the grounding blade 62 and the power blade 60 are illustrated in phantom in their place in the connector.

It is evident that the end portion 18 of boot 10 covering the connector is illustrated to retain its position against the contact housing 58. Further the end portion 18 of the boot 10 covering the cap to the right of the figure slides up and over and around the end portion 18 of connector boot on the left of the figure. It must be emphasized that there is no effort or special procedure or measures which must be followed in order to accomplish this alignment of the end portions 18 of the cap boot and the end portion 18 of the connector boot. In fact, what happens is that as the cap and connector are joined, there is a flexing and deflection of the respective end portions so that an alignment as illustrated in FIG. 7 is accomplished automatically and without any special effort on the part of the party joining the cap and connector.

Alternatively it is found that in some cases the two end portions 18 of the connector on the left and of the cap on the right take the reverse position to that illustrated in FIG. 7. In this case the end portion 18 of the boot 10 covering the cap 40 slides under and makes direct contact with the contact housing 58 of the connector. At the same time the end portion 18 of the boot over connector 39 rides up and over and comes to rest about the outer surface of the end portion 18 of the boot on cap 40. Again it is important to point out that this alignment of the end portions to form automatically the overlapping seal therebetween is accomplished automatically with the joining of the cap and connector and there is essentially no requirement for special measures or steps to be taken to accomplish this formation of an overlapping seal between the respective end portions 18.

From the foregoing it is obvious that a unique boot for caps and connectors is provided pursuant to this invention. In particular a single form of boot is employed with both a cap and connector or with either, and a seal is formed between the two boots even though the two boots on the mating cap and connector are identical in form and shape.

There is another advantage to the boot provided pursuant to this invention and the use of this single form of boot is illustrated in the FIG. 9. In FIG. 9 a cap 40 is enclosed within a boot. And the blades 60 and 62 are plugged into a receptacle 64 mounted in a wall 66. In this case the cap 40 is provided with the boot 10 of the same form described above with reference to the other figures and in fact the boot 10 may be the same boot which is described in reference to the other figures. This boot includes the tapered end portion 16, the beveled portion 28, the midportion 14, and the end portion 18. What is unique about this same boot in the application illustrated is that it is feasible to fold back the end portion 18 from the extended position in which it is illustrated in the other figures to a folded or reverse bent position illustrated in FIG. 9. By doing so, a fold 68 is formed at the end portion 18 of the boot or at the juncture where the end portion and the shoulder 50 meet. Once the end portion 18 is folded back, it tends to remain there and does not produce a substantial elastic bias such as would tend to urge the blades 60 and 62 out of the receptacle 64.

It should be noted that the insertion of a cap into a receptacle as illustrated in FIG. 9 can be accomplished with the straight blade contacts illustrated in FIG. 9 or with the locking type of contacts which are frequently employed with caps and connectors. In fact, it should be clear that the boots of this invention may be employed equally well with combinations of caps and connectors which are of the locking variety as well as with combinations which are of the straight blade variety illustrated in these figures. This result obtains partly because a gripping force can be transmitted through the pliable boots of this invention to apply a tortional pressure to the cap and connector to be locked together or to be unlocked. The overlapping seal formed automatically between the end portions 18 of the respective boots as described above with reference to FIGS. 7 and 8 forms equally well with caps and connectors having blades and contacts of the locking variety. One factor which is helpful in the joining and separation of the caps and connectors is that there is a band 35 and there is a matching gap 46 between the two portions of the cap or of the connector so that as the boot around the cap or connector is gripped by the user with hand pressure, there is a tendency for the band 35 to be urged into the gap 46 and to provide an easy means for transmitting the hand pressure from the exterior of the boot through the boot and through the cap and connector to the blades which are to be engaged or disengaged.

As is evident from the above, a principal inventive feature of the present invention is the construction of a boot which can form a seal with another boot of the same configuration. Further, this can be done without any special steps, measures, or provisions to implement the seal. Rather, the seal is formed in the normal use of the unique boots.

Since the other portions of the boots can be provided in many forms without departure from the spirit and scope of this invention, the foregoing is not to be interpreted in a limiting sense as concerns the portion of the boot other than that which forms the seal and the portion of the boot adjoining that which forms the seal.

What is claimed and desired to be received by Letters Patent of the United States is:

1. A pair of boots for shielding a cap and connector, said boots each being an elongated self supporting sheath of resilient material,
- each boot of said pair conforming in its dimensions to those of the other boot of the pair,
- each sheath having a rear section which bears against and about a cable extending respectively from a cap and a connector in said sheaths,
- means for positioning the front end of each sheath relative to the front of the cap and connector disposed therein,
- and each sheath having a pliable front section extending from contact and in contact respectively with a front end surface of said cap and connector,
- each sheath front end section having resiliency sufficient to permit it to expand over and about a front end section of the other boot of said pair.

2. The boot of claim 1 wherein the positioning means are means internal to the boot adapted to cooperate with external means of a connector disposed therein.

3. A boot for an electrical connector having an annular recess at a midportion of the body thereof, said boot comprising a resilient tubular sheath,
- a. a midportion of said sheath having a diameter conforming closely to that body of said connector,
- b. a front end portion of said sheath having a diameter smaller than that of the midportion,
- c. a tapered rear wall portion at the opposite end of the sheath,
- d. an internal annular boss adapted to nest in a conforming annular recess of the body of said connector,
- e. a cord gripping constriction extending from the tapered end of boot.

4. An article which comprises in combination a cap having ends and a boot about the cap, said cap being characterized by blades extending from one end thereof and a cable extending from the other end thereof, said boot being an elongated self supporting sheath of resilient material, said boot having a rear section which bears against and about said cable, said boot having means for positioning a front end section thereof about the blades as a shirt, and the skirt of the sheath having resiliency sufficient to permit it to expand over and about a front end portion of a second boot having substantially the same shape and dimensions as the first boot.

5. An article comprising:

in combination a connector having ends and a boot about the connector, said connector having a cable extending from one end thereof and having a set of contacts with an insulated housing at the other end thereof arranged at blade openings to receive matching blades of a cap, the boot being an elongated self supporting sheath of resilient material, said boot having a rear section which bears against and about said cable, said boot having means for positioning a front section thereof about a contact housing of said connector, and the front end section having resiliency sufficient to permit it to expand over and about a front section of a second boot said second front end section having substantially the same dimensions as the front end section of the first boot.

* * * * *